United States Patent [19]

Corbin et al.

[11] 4,274,243

[45] Jun. 23, 1981

[54] ASPHALT SHINGLE FOR SIMULATING A TILED ROOF

[75] Inventors: Raymond L. Corbin, Littleton; Robert F. Reinhart, Aurora, both of Colo.

[73] Assignee: Johns-Manville Corporation, Denver, Colo.

[21] Appl. No.: 970,720

[22] Filed: Dec. 18, 1978

[51] Int. Cl.[3] ..... E04D 5/10

[52] U.S. Cl. ..... 52/748; 52/557; 156/264; 427/187

[58] Field of Search ..... 52/748, 314, 557, 558, 52/559; 427/187, 186, 188; 156/264, 265; 428/141, 192

[56] References Cited

U.S. PATENT DOCUMENTS

| | | | |
|---|---|---|---|
| 891,501 | 6/1908 | Overbury | 52/555 |
| 1,609,921 | 12/1926 | Wright | 427/188 |
| 1,688,917 | 10/1928 | Busha | 52/559 |
| 1,900,598 | 3/1933 | Doyon | 427/187 |
| 1,913,836 | 6/1933 | Hamlin | 52/559 |
| 3,132,964 | 5/1964 | Young | 427/188 |
| 3,624,975 | 12/1971 | Morgan | 52/557 |
| 3,921,358 | 11/1975 | Bettoli | 52/555 |

*Primary Examiner*—John E. Murtagh

*Attorney, Agent, or Firm*—Robert M. Krone; Joseph J. Kelly; Gregory W. O'Connor

[57] ABSTRACT

The present invention relates to the field of roof coverings, specifically laminated roof shingles formed of mineral granule covered, asphalt saturated felt material. The disclosed shingle when combined with other shingles on a roof deck simulates a tile covered roof. This simulation is accomplished by making a generally rectangular laminated shingle having a headlap portion and an exposed butt portion made up of a regular uniform series of substantially identically shaped tabs with spaces therebetween defining exposed portions of an underlay member attached to the lower surface of the tabs. The lower edges of these tabs and spaces define a butt edge having a generally continuously curving sinuous contour. The tabs have generally straight sides which taper from this butt edge to the lower edge of the headlap portion. A plurality of such shingles are placed on a roof deck such that the tabs are aligned vertically up the roof deck and the spaces between these tabs are also vertically aligned. This simulation is emphasized by random color shading provided by the mineral granule covering. The disclosed shingle is used to cover roof decks where aesthetic decisions dictate the desirability of having a tile covered roof.

8 Claims, 7 Drawing Figures

ASPHALT SHINGLE FOR SIMULATING A TILED ROOF

TECHNICAL FIELD

The instant invention is in the technical area of roof coverings and in particular the generally planar, flexible rectangular roof shingles which are usually constructed of a felted material which is made waterproof by being saturated or otherwise impregnated with asphalt. An asphalt shingle generally has a weather surface comprising a covering of mineral granules adhered to at least one face thereof by a further coating of asphalt or other adhesive material. Such a shingle may be made of a single piece of such mineral granule coated, asphalt impregnated, felted material. The butt edge thereof usually has particular contour which provides certain aesthetic features to a roof covered with a plurality of such shingles. This butt edge can also provide an edge feature which aids in positioning such shingles relative to one another on a roof to aid in the installation thereof. Alternatively, such shingles may be formed by laminating two or more pieces of material together in order to increase its weight and durability and also to further enhance the aesthetic appeal of the butt edge and/or butt portion of the shingle by providing aesthetic features to the mineral granule covered surface thereof and by imparting increased thickness to at least selected portions of the butt edge.

BACKGROUND OF PRIOR ART

In the past roofing shingles of the type disclosed have had to satisfy two main functions when applied to a roof deck. The first of these functions has been to provide a durable, weatherproof covering for the roof deck. Roof shingles, whatever their form, are intended to provide a means of sheltering the structure below the shingles from precipitation and the deleterious affects of sun and wind. The roof shingles installed on the roof deck must perform these protecting functions for a reasonable period of time. The second main function has been that of presenting an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings such as for example, thatch, wooden shakes, slates, and even tiles of various forms.

Clearly, this aesthetic function is best satisfied with aesthetic features which are effective, that is, successfully simulate the overall visual impression of such other more traditional, and arguable more expensive roof coverings. An example of a successful simulation is illustrated by a product marketed under the Trademark WOODLANDS by the Johns-Manville Corporation. This asphalt shingle is of the laminated type. That is, it is composed of an overlay member having a headlap portion and a butt portion. The butt portion of the overlay member has a series of tabs having varying widths. These tabs have spaces therebetween which vary in width also. There is an underlay member positioned below these tabs and spaces which together therewith defines the exposed or butt portion of the shingle. The tab and the portion of the underlay member positioned thereunder form a double thick portion of the butt portion. The portion of the underlay member positionally corresponding to the space between tabs forms a single thick portion of the butt portion. When combined with a series of substantially identical shingles, these random double thick portions cooperate to simulate quite successfully a cedar shingle shake covered roof. The random widths of the tabs form courses of what appear to be traditional cedar shingles. These shakes appear to have random variations in thickness, which appearance is brought on by the butt edge of the single thick and double thick portions of the butt portions of the shingles in a course positionally corresponding to the upper edges of the spaces between the tabs of the shingles in the course of shingles immediately therebelow. This overall rustic, cedar shake appearance is further enhanced by the use of substantially random changes in color or the mineral granules covering the weather surface of the WOODLANDS shingle.

Another example of a laminated type asphalt shingle having irregular butt edges simulating a shake shingle is that disclosed in U.S. Pat. No. 3,921,358. Of particular interest is the system of forming the random tabs in which pairs of overlay members are constructed with interleaving tabs, the tab of one of the pairs of overlay members defining the space in the other one of said pairs of overlay members as shown in FIGS. 5*a* and 5*b*. Also, FIG. 4 shows how the single thick and double thick portions of the butt portion of one shingle cooperate with the upper edge of the spaces of the shingle immediately therebelow so as to form a butt edge having what appears to be three different thicknesses. Other examples of asphalt shingles having features to simulate a wood or shake shingle are shown in U.S. Pat. Nos. 3,927,501 and 1,495,070.

Not all asphalt shingles are intended to simulate a shake or wood shingle. For example, U.S. Pat. No. 891,501 discloses a strip shingle having identically shaped tabs along its butt edge, these tabs being separated by spaces also having identical shapes. These strip shingles are laid on the roof in one of two configurations. The aesthetic effect in both configurations is to simulate panels or columns at right angles to the length of the strip shingles, these panels or columns being of such form to give a checkered effect to the roof or to the side of a building. These effects should be contrasted to the random irregular effect as achieved in the embodiments of the patents listed above.

A strip shingle indicated as being useful in simulating the appearance of a tile roof or other ornamental form is disclosed in U.S. Pat. No. 1,295,360. The shingle disclosed therein has a butt edge consisting of a regular series of negatively curved portions between pointed tabs. Each tab has a deep slot or cutout extending vertically therethrough. These strip shingles are intended to be laid in overlapping relationship with the slots or cutouts of one course in vertical registry with the corresponding feature of the adjacent courses in order to give the alleged appearance of a roof covered with curved tiles, and with battens between these tiles. It is stated that the effect desired can be heightened by forming strips of darker colored mineral aggregate on what would correspond to the shaded side of the upwardly curving tiles on the simulated tiled roof. Another example of a tile simulating roofing shingle is disclosed in U.S. Pat. No. 966,178.

A similar concept is disclosed in a publication by the Roofing Granule Division of the 3-M Company (Minnesota Mining & Manufacturing Co., 2501 Hudson Road, St. Paul, Minnesota 55101) wherein a display panel apparently carrrying an experimental shingle design shows a cartoon-like simulation of a series of vertically aligned cylindrical tiles in shades of terra-cota red. What would be the equivalent to the shaded side of these cylindrical tiles are shown by a vertically defined darker portion demarcated at an edge (which would correspond to the intersection of one cylindrical tile with another) by a very dark black line.

However, none of these prior tile simulating asphalt shingles have been able to combine, in a practical and commercially successful way, the aesthetic and protective functions to the extent that the shake simulating shingles have. While a tile roof can be optically mimicked by providing mineral granules having a darker color to those portions of the butt portion of the shingle which would, when the desirably shaped butt edge is taken into account, correspond to the shaded portion of a three dimensionally curving tile member, such application of mineral granules has not been successfully accomplished on a practical production scale.

BRIEF SUMMARY OF THE INVENTION

It is an object of the present invention to provide a shingle which comprises a headlap portion and a butt portion. This butt portion extends from the lower boundary of the headlap portion to the butt edge of the shingle and comprises a series of tabs separated by spaces which extend from the headlap portion to the butt edge. Positioned beneath at least the tabs and fixedly attached thereto is positioned an underlay member. This underlay member thus has portions underlying each tab and further includes exposed portions extending between these tabs in the spaces which separate the tabs. The lower edge of each tab defines a portion of the butt edge of the shingle having a generally smoothly and continuously curved contour. The lower edge of the exposed portions of the underlay member (in the spaces between the tabs) define a portion of the butt edge of the shingle having an oppositely curved contour. The lower boundary of the headlap portion has a contour substantially corresponding to the contour of the butt edge. Thus this shingle, when laid on a roof with other substantially identically shaped shingles in overlappping longitudinal courses in a predetermined assembly in which the tabs of these identical shingles in each course are vertically aligned, operates to optically simulate the three dimensional ridges and valleys of a tiled roof.

The simulative aspect of this roof shingle is further enhanced by a covering of mineral granules in the form of a substantially random series of color drops, this series progressing in the direction of the width of the shingle, this series of granule drops defining a corresponding series of transition areas between the adjacent color drops such that, in a sampling of the shingles made according to the instant invention, at least some of these transition areas positionally correspond to the approximate geometric centerlines of at least some of the tabs and the exposed portions of the underlay members of the shingles in the sampling.

The instant invention also embraces a roof covering comprising a plurality of successive generally horizontal courses of generally planar roofing shingles. The shingles in each course are laid side-by-side and each shingle is horizontally offset from the shingles in adjacent courses. Each shingle comprises a headlap portion and an exposed butt portion. The butt portion comprises a series of tabs separated by spaces, each of these tabs extending in length from the headlap portion to the butt edge. Each shingle further comprises an underlay member extending the length of the shingle and fixedly positioned beneath the tabs so as to form a double-thick portion corresponding to each tab and a single-thick portion corresponding to the spaces between these tabs. The butt edge has a generally undulating contour such that each tab has a lower edge having a negatively curved contour and the lower edge of each exposed portion of said underlay having a generally positively curved contour.

Desirably, each shingle making up the roof covering is of substantially identical shape and each tab is of substantially identical shape. Each tab has a width which tapers along generally straight sides to a slightly narrower dimension approximate to the lower boundary of the headlap portion. The spaces between each tab taper from the lower boundary of the headlap portion to a slightly narrower dimension at the butt edge of the shingle.

A method of forming a laminated roofing shingle comprises the steps of providing an indefinite length of asphalt impregnated felted material. Then a coating of mineral granules is adhered to at least one surface of this felted material. The method further includes the step of cutting the material in a repeating pattern along the longitudinal dimension of the material so as to form an interleaved series of tabs of pairs of overlay members. Each tab defined by this step of cutting is of substantially identical shape, the lower edge of each tab being defined by a smoothly curving negatively contoured edge. The process further comprises the step of making pairs of underlay members in a manner similar to making the overlay members as above, but wherein the lower edges of the underlay members of these pairs are defined by a substantially continuously curving sinuous cut having a uniform periodic shape and amplitude such that each pair of underlay members thus formed are substantially identical. Finally, the underlay members are laminated to the overlay members so as to form a series of shingles having substantially the same overall shape.

Desirably, the step of laminating further includes the step of positioning the negatively contoured edge of each tab directly over a substantially correspondingly curving portion of the lower edge of each underlay member so as to simulate a series of alternating ridges and valleys of a portion of a tile covered roof.

As to the step of adhering, it is further desirable to alternate color drops of contrastingly colored mineral granules with color drops of a composite of granules having the colors selected from each of the contrasting color drops. The composite color drops desirably have a length in the longitudinal direction of the felted material of about five inches (12.7 cm) and the contrasting color drops having a length in the longitudinal dimension of the felted material of approximately nine inches (22.86 cm).

The instant invention further includes a method for optically simulating a tile covered roof comprising the steps of forming a series of substantially identical overlay members, each of the overlay members comprising a series of substantially uniformly shaped tabs, each of these tabs having a negatively curved contour at the lower edge thereof and each tab having a width defined by generally straight edges tapering inwardly to a width narrower than the width at the lower edge; forming a series of substantially identical underlay members, each underlay member having a lower edge with a substantially continuously curving uniformly periodic undulating contour; bonding one overlay member of the series of overlay members to one underlay member of said series of said underlay members so as to form a shingle of generally rectangular form having a headlap portion and a butt portion. The butt portion comprises a series of uniformly spaced double thick tab portions with a space between each tab portion defining an exposed portion of said underlay member; repeating this step of bonding to form a plurality of laminated shingles; and covering a roof deck with the thus formed laminated shingles by: (1) laying said shingles side-by-side in a horizontal course, (2) overlapping said course by a next higher course of shingles such that the headlap portion of each shingle therein is substantially covered by the butt portions of the shingles in that next higher course, and (3) vertically aligning the tabs of each shingle with the tabs of the shingles in each succeeding course such that the tabs form vertical lines proceeding up the roof deck and the spaces form lines parallel to the lines of the tabs such that the vertical patterns and the curving butt edges of the tabs and spaces optically cooperate to simulate a tile covered roof.

DETAILED DESCRIPTION OF INVENTION

Figure 1:
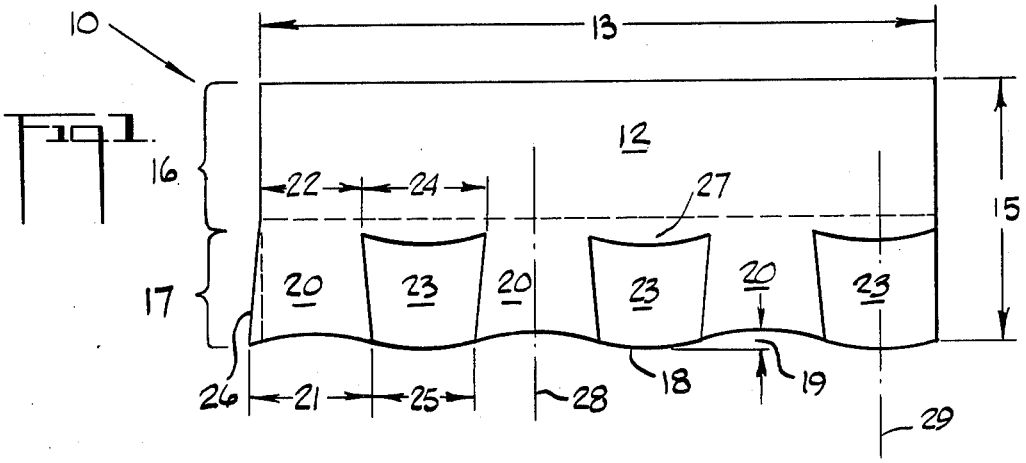
FIG. 1 shows a planar view of a laminated shingle according to the instant invention.

The present invention can best be seen when the accompanying drawings are viewed in conjunction with the description wherein like reference numerals refer to like structures thoughout the drawings.

Figure 2:
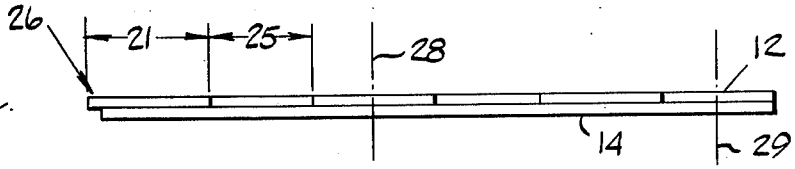
FIG. 2 is an edge view of the shingle shown in FIG. 1.

Attention is directed to FIGS. 1 and 2 which illustrate a preferred embodiment of a shingle in accordance with the present invention. Shingle 10 is of a type of roofing shingle generally known as a laminated type shingle consisting of overlay member 12 and underlay member 14. These two members are preferably constructed of a laminar felted material comprising organic or inorganic fibers, or a mixture of both. These fibers are held together usually with a binding agent and are subsequently coated, saturated, or otherwise impregnated with an asphaltic bituminous material according to notorious processes in the roofing industry. In detail, the overall shape of this shingle differs considerably from other known shingles (it is from this shape that many of the beneficial aspects of Applicants' invention are derived). The overall construction is however, (with great benefit to the practical aspects of the instant invention) similar to other known shingles of the laminated shingle type. As can be seen from FIGS. 1 and 2, the overall generally rectangular shape has a width 13 of approximately 3 feet (90 cm) and an overall height 15 of approximately $13\frac{3}{4}$ inches (34 cm). This height 15 is generally divided into a headlap portion 16 and an exposed butt portion 17, which, when arranged with other similar shingles on a roof deck in a manner as will be set forth more fully below, will have a dimension of approximately $5\frac{3}{4}$ inches (14.6 cm). Hence by definition the lower boundary or edge of the headlap portion is determined by the location and shape of the butt edge of the overlapping shingles in the next course of shingles on the shingle covered roof deck. The exposed butt portion 17 includes a series of tabs 20 which are in turn separated from one another by an equivalent series of spaces 23. Each tab 20 has a lower edge which substantially corresponds to part of butt edge 18 of overall shingle 10. The upper edge of each tab 20 is substantially defined by and corresponds to the lower boundary of headlap portion 16. In contrast with similar prior art shingles having the aesthetic function of simulating a cedar shake shingle, each tab 20 of shingle 10 according to the instant invention is desirably of identical size and shape. Additionally the width 21 of the lower edge of tab 20 is larger than the width 22 of the upper edge of tab 20. Hence, each tab 20 tapers from the lower edge thereof along generally straight sides to its narrowest dimension 22 at the lower boundary of headlap portion 16. In the preferred embodiment, the dimension 21 is about $6\frac{3}{8}$ inches (16.2 cm) and dimension 22 is about $5\frac{3}{8}$ inches (13.7 cm). Each space 23, in contrast with each tab 20, tapers from its widest dimension 24 at the lower boundary of headlap portion 16 to its narrowest dimension 25 at the lower edge of space 23. For reasons as will be set forth below, it has been found desirable to make the narrowest dimension of each tab 20 and each space 23 (dimensions 22 and 25, respectively) of substantially the same magnitude. By the same token it has been found desirable to make the widest dimension of each tab 20 and each space 23 (dimensions 21 and 24, respectively), of the same magnitude also. Further defining the shape of each tab 20 is centerline 28 about which each tab 20 is substantially symmetrical. In like manner, each space 23 is substantially symmetrical about centerline 29.

Figure 3:
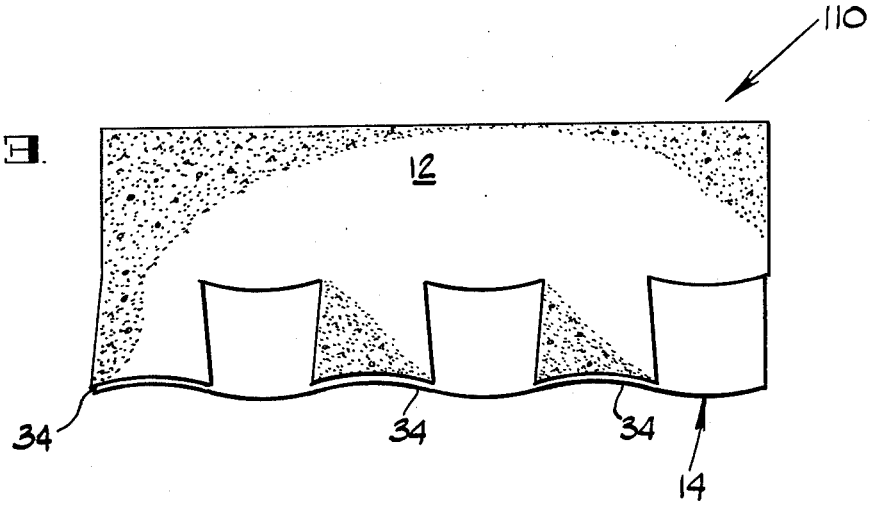
FIG. 3 is a modification of the shingle shown in FIG. 1.
Figure 4:
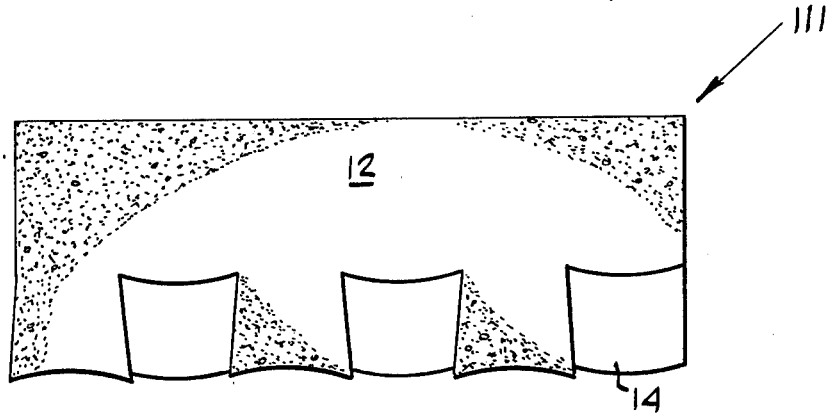
FIG. 4 is a modification of the shingle shown in FIG. 1.

Butt edge 18, and hence the lower edges of each tab 20 and space 23 are important to the overall design of shingle 10 and its cumulative effect when arranged with other shingles of similar shape. It can be seen from FIG. 1 that the lower edge of tab 20 (and the lower edge of the underlying portion of underlay member 14 positionally corresponding to each tab 20) define a portion of butt edge 18 which has a generally smoothly and continuously curved contour. In the preferred embodiment this is a negatively curving contour which substantially corresponds to a circular segment of a radius of about $10\frac{3}{8}$ inches (26.35 cm). In contrast, the lower edge of the exposed portions of the underlay member 14 in the spaces 23 define another portion of butt edge 18 which has an oppositely curving contour. In the preferred embodiment this portion of butt edge 18 corresponds to a circular segment having a radius of about $8\frac{7}{8}$ inches (22.54 cm). It should be noted that the precise geometrical shape of each curving portion of butt edge 18 is not critical to the overall invention. Whatever shapes are used to define butt edge 18, for best effect the result should (except for slight discontinuities caused by differences in precise alingment of the overlay member 12 and underlay member 14 as illustrated in FIGS. 3 and 4) be a generally uniformly curving undulating edge having a uniformly periodic shape and a uniform amplitude as defined by distance 19. Amplitude 19 in this preferred embodiment is about 1 inch (2.54 cm), although a greater amplitude may be desirable in certain instances, as for example when the three dimensional effect of the overall roof structure is to be further emphasized.

Overlay member 12 and underlay member 14 are fixedly attached t one another in the completed shingle 10. This attachment function is provided by bituminous adhesive materials applied to the surfaces between each tab 20 and the corresponding underlying portion of underlay member 14. Additionally it is desirable to provide common bonding area 27 which extends substantially the full width 13 of shingle 10 above the upper edge of each of spaces 23 and positionally approximating the lower edge of head lap portion 16.

While it was stated above that each tab 20 and each space 23 of shingle 10 are of substantially identical shape and symmetrical with their respective centerlines 28 and 29, it can be seen from FIG. 1 that the right-most space 23 differs along its right-most edge from precise identity of shape and symmetry. The reason for this can be seen when the right-most edge is related to the left-most edge of shingle 10 and in particular to overlap portion 26 of left-most tab 20. As will become more apparent, the overlap portion 26 overlaps the right-most edge of right-most space 23 of the just preceding shingle in each course of a covered roof deck. Such overlapping cooperation not only results in right-most space 23 of each such shingle having identity of shape and symmetry with such other spaces 23, but also aids in providing a more waterproof roof deck covering.

Figure 5:
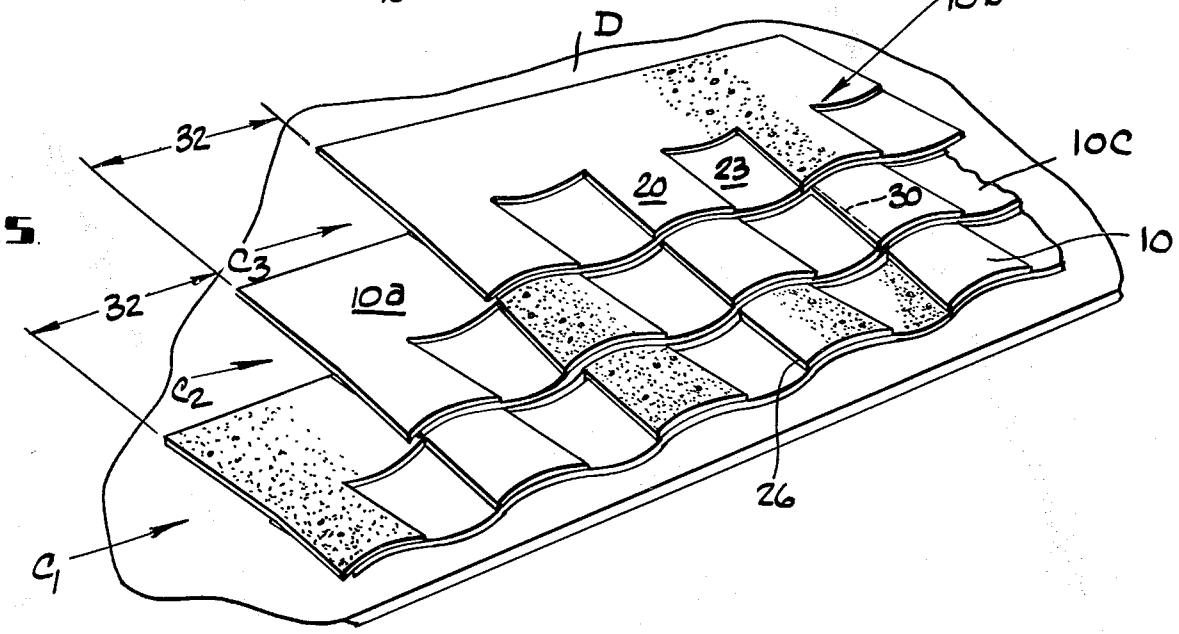
FIG. 5 is a perspective view of a portion of a roof deck covered with shingles according to the instant invention.

This feature of Applicants' invention as well as other features can be better seen in FIG. 5. FIG. 5 shows a fragment of roof deck D with a roof covering according to the present invention made of a plurality of roofing shingles similar to that shown in FIG. 1. Generally, the roofing shingles 10 are arranged in a series of horizontal courses of which portions of three such courses C-1, C-2 and C-3 are shown. Shingle 10*a* in course C-2 is shown being overlapped by shingle 10*b* in course C-3. Immediately adjacent to shingle 10*a* in course C-2 is shown in the fragmentary form a shingle designated as 10*c*. The extreme left-most edges of both shingles 10*a* and 10*b* are shown without the shingles which would normally precede these shingles in each of the courses. This is done in order to more fully illustrate the desired placement of each shingle in each overlapping course. Hence it is of course understood that roof deck D in the finished tile simulating roof covering would be substantially completely covered by a plurality of substantially identically shaped shingles 10*a*, 10*b* etc. Illustrating the function of overlap portion 26 along the leading or left-most edge of each single left-most of each tab 20 is the dotted line 30 which defines the hidden right-most edge of shingle 10*a*. It can be seen that overlap portion 26 operates to hide this trailing edge of shingle 10*a* from view, and as stated above, causes space 23 immediately adjacent thereto to have a shape which conforms substantially to the other spaces 23 of each shingle making up the roof covering.

Another feature of the instant invention illustrated in FIG. 5 is the desirable sequence in which the shingles making up each overlapping course are laid. Preferably courses C-1 would be laid for a substantial horizontal distance along Deck D. Then, shingles making up course C-2 are laid in overlapping fashion such that the headlap portions of the shingles making up course C-1 are covered by shingles in course C-2. Also it should be noted that the identically shaped shingles in overlapping longitudinal courses (as in this example C-2 and C-3) are longitudinally offset by a predetermined distance 32. The broad concept of longitudinally offsetting shingles in subsequent overlapping courses is known in the roofing art. This longitudinal offset serves to prevent the joint which is formed between each adjacent shingle in each course from positionally corresponding to the joint between the shingles in the subsequent overlapping course. If this were not done, water from precipitation would inevitably penetrate these joints and find its way to and potentially damage the underlying roof deck D. In offsetting these joints there is no direct path for such water between each shingle since, as illustrated by the joint between shingle 10*a* and 10*c*, the joints are covered over and completely hidden by the butt portion of shingle 10*b* as well as the overlap portion 26 of the left-most tab 20 of shingle 10*c*. Of interest to the overall aesthetic effect of the preferred embodiment of the instant invention, however, is that distance 32 is in this case equal to exactly one third of the overall width 13 of each shingle. The choice of this distance 32 can readily be seen when one views another feature of the instant invention, that is the vertical alignment of each tab 20 and each space 23 of the shingles in each longitudinal course. Hence, as can be seen from the fragmentary view in FIG. 5, each tab 20 in courses C-1, C-2 and C-3 are aligned along vertical lines leading up deck D. Since each tab and each space are substantially identical in shape and dimension, each space 23 is equivalently aligned along a vertical line going up deck D. The overall optical effect of these vertical alignments is quite different than that of the prior art shingles which are intended to simulate a shake roof. There is no random effect. On the contrary, the uniform shapes emphasize the vertical components of the pattern which are simulative of and evoke the ridges and valleys (also known as caps and water courses) of a tiled roof. As each shingle is made up of three sets of one tab 20 and one space 23, the offset distance 32 of one third the overall width (or the distance equal to one tab and one space) of each shingle results in not only maintaining the vertical alignment of tabs and spaces, but also (as set forth above) prevents water leakage through a roof deck covered with such shingles. Of course it should be understood that a shingle in accordance with Applicants' invention need not have three tabs and three spaces making up its butt edge. While the configuration shown in the Figures is preferred, other configurations are possible, although less practical. For example, the shingle could have as few as two tabs or as many as six tabs or more without departing from the invention.

The choice of the shapes for butt edge 18 and the top edge of each space 23 becomes apparent from FIG. 5. As can be seen, each shingle in each subsequent overlapping course is positioned so that not only are each tab and each space vertically aligned as stated supra, but also the butt edge of each shingle in subsequent overlapping courses is positioned to substantially correspond to the upper edge of each space 23. This substantial correspondence results in an apparent edge thickness at the lower edge of each space 23 which corresponds to twice the thickness of the exposed portion of underlay member 14 in each space 23. This feature, combined with the double thick portion of each butt edge defined by each tab 20, provides a heightened shadow effect and further enhances the tile simulating aspect of the instant invention.

While FIG. 4 illustrates a roof covering which utilizes the shingles of FIG. 1, it should be understood that a number of variations are embraced by the instant invention (see FIGS. 3 and 4). FIG. 3 shows a shingle 110 which is in many aspects substantially identical to shingle 10 of FIG. 1. Shingle 110 is made up of overlay member 12 and underlay member 14 substantially identical to the previously described overlay and underlay members. However, the lower edges of each tab are vertically offset from the lower edge of underlay member 14 such that a negatively curving contoured portion of the underlay member 14, here designated as 34, is exposed along the butt edge. Such a configuration has been found desirable when the horizontal component of the overall pattern of a roof deck covered with such shingles, (which is in part defined by the continuing undulating edges of each shingle in each course), is to be deemphasized. The negative contoured portion 34 of underlay member serves to deemphasize the shadow edge effect at the butt edge of each shingle corresponding to the lower edge of each tab. The strong shadow edge effect on the butt edge corresponding to the lower edge of the space portion 23 is substantially maintained by its alignment with the upper edge of each each space in the just preceding course. Hence, the horizontal sinuous pattern is broken up as the shadowline along the butt edge ceases to be created by an essentially continuous double thick butt edge portion.

A further alternative in this concept is shown in FIG. 4. Here, underlay member 14 is displaced such that the lower edge of the underlay member is disposed beneath the tabs and thus towards the headlap portion of shingle 111. This shingle, when combined with other similarly completed shingles in a manner very similar to that shown in FIG. 5, accomplishes a similar benefit to that set forth in reference to shingle 110. However, in this case the shadowline along the butt edge of the shingle corresponding to each space 23 is deemphsized. This is accomplished by aligning the lower edge of each tab portion along the lower edge of the headlap portion of the shingles in the just preceding course. This causes the lower edge of each space portion of that shingle to be displaced upwardly from the upper edge of the corresponding space of the shingle in the just preceding course. Hence, the otherwise continuous shadowline between each course is broken up by forming alternating single thick portions (corresponding to the spaces) and double thick portions (corresponding to the tabs).

Once disclosed, alternative methods of constructing a shingle according to Applicants' invention become apparent. For example, butt portion 17 could be made up of a series of separate tabs 20 adhered to appropriate locations along the lower edge of an underlay member. Overlay member 12 would cease to exist as a single entity in this instance, although separate tabs 20 could be considered as collectively constituting an overlay member. Thus, the underlay member in this construction would extend the full length of the shingle, and would thus extend over the headlap portion as well as constitute a major portion of the exposed butt portion of the complete shingle.

Another aspect of the instant invention which contributes to the overall simulative effect is the utilization of an essentially randomly varying series of differently colored portions of a mineral granule covered surface. This covered surface extends over at least the exposed portions of shingles according to the present invention. As stated previously, the use of a mineral granule covering to provide a weather resistant surface treatment to asphalt shingles is old. The use of such a covering having randomly varying color contrasts or hues has also been used in the past to enhance the effects of the shape of such shingles in order to present a generally randomly varying surface to simulate cedar or wood shake roofing elements. However, the instant invention takes full advantage of the economic benefit of this random surface treatment and, when combined with the distinctive and uniformly repeating butt edge shapes and tab shapes of the instant invention, provides a unique aesthetic function as will hereinafter be described.

The mineral granule surface of Applicants' shingle is provided by a known process in which an indefinite length of essentially waterproof (coated or otherwise impregnated with an asphaltic material) felted material is provided with an adhesive layer of asphalt material. Against this now adhesive surface, mineral granule particles are mechanically adhered in a process step known in the industry as a slate drop step. This operation comprises passing the adhesive coated surface of the felted material beneath a machine which includes a series of mineral granule filled bins positioned above the longitudinally moving felted material. There are preferably at least five such bins of which four are used to hold four different basic color blends of mineral granules. The fifth bin contains preferably a composite of the colored granules contained in the other bins, since such composite has been found to not only add an aesthetically pleasing color variation in roofing shingles but also permits the utilization of the inevitable accumulation of the spilled granules from the operation of the other bins. This known piece of roofing machinery is capable of permitting the mineral granules contained in all of these bins to be selectively dropped onto the adhesive upper surface of the felted material as it passes beneath these bins. This selective dropping of mineral granules results in a series of "color drops," that is, a series of bands of mineral granules, each band having a color contrasting with the color of the mineral granules in the bands adjacent thereto. For reasons that will become apparent, this machine is operated to alternate color drops between all of the mineral granule bins being used in an essentially random fashion. The term "essentially random fashion" is used since the machinery available on the market is able to set up a pattern of alternating color drops of granules which is repeated only after 120 such color drops. As will become apparent, this 120 drop cycle results in a pattern of such color drops which, for practical purposes, is undetectable visually from an entirely random, nonrepeating pattern.

Figure 6:
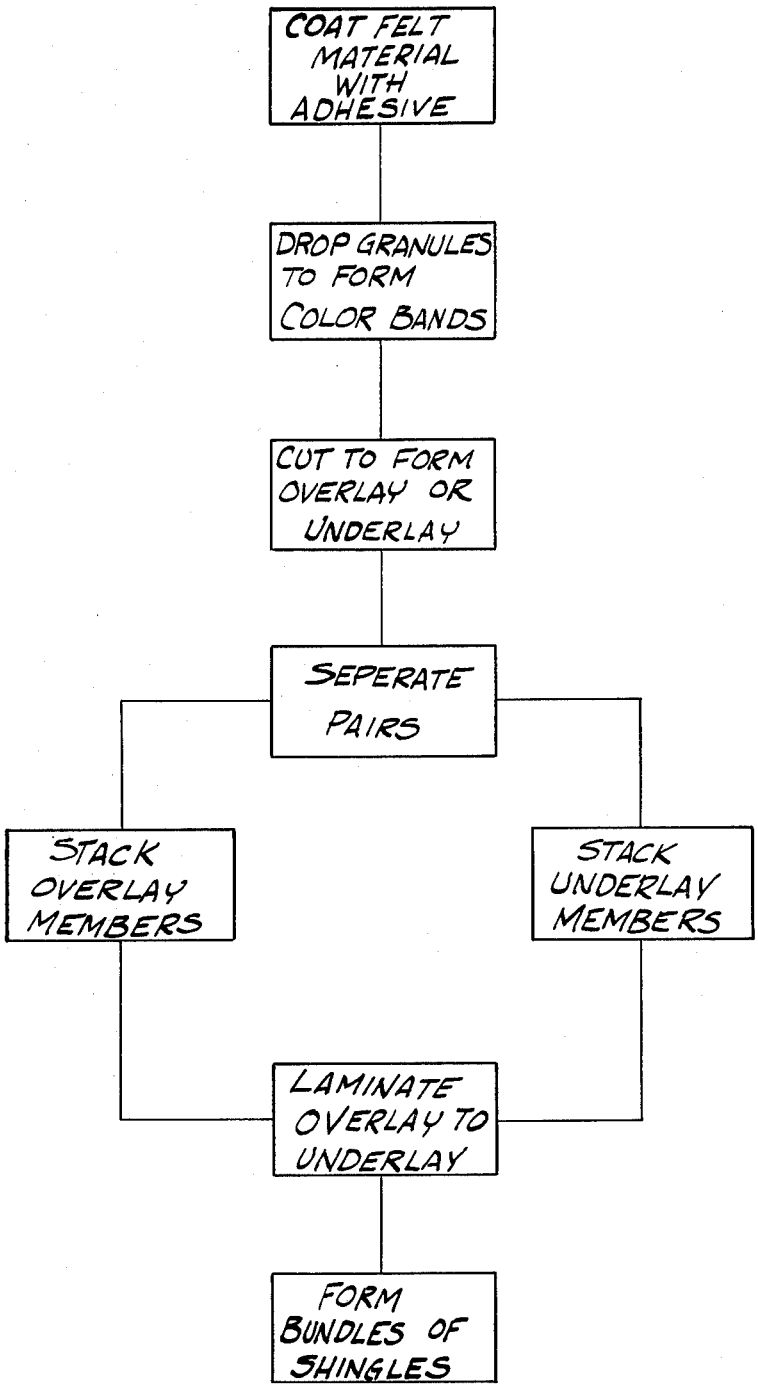
FIG. 6 is a schematic of a process of forming a shingle according to the instant invention.

The overall process for forming the mineral granule coated shingles according to the instant invention can best be understood by reference to FIG. 6. As stated before, the length of felted material is first coated with an adhesive material, preferably an asphaltic material. Then the thus coated material is passed through the apparatus as set forth above in which the color drops are randomly placed across its upper surface. Then the thus granule coated material is passed between cutter rolls which operate to divide the material into either pairs of overlay members or into simultaneous pairs of overlay members and at least one pair of underlay members. After being thus cut the underlay and/or overlay members are separated by what is termed a plow in an operation of a notorious type. Then the thus formed overlay and underlay members are stacked or moved to another station for the laminating operation. In the laminating step of the process the lower surface of the overlay member corresponding to the common bonding area 27 of the underlay member 14 is provided a strip of an asphaltic type adhesive material. This adhesive material may be preferably supplemented with equivalent strips of adhesive material on the lower surfaces of each of the tabs 20. Then each underlay member is positioned beneath each overlay member. This positioning can be such that the lower edge of the underlay member which would correspond to the lower edge of each tab is precisely aligned with that lower edge in order to result in a laminated shingle such as that shown in FIG. 1. The alternatives in FIGS. 3 and 4 result by displacing this orientation in the manner as set forth above. In any event, the overlay members and underlay members are pressed together to bring the adhesive material on the underside of the overlay member into intimate contact with the corresponding surfaces of the upper surface of the underlay member 14. Once bonded, the shingles are then provided with other optional features such as alignment aids or interrupted strips of a heat activated sealing material, both of which aid in the installation and maintenance of an essentially waterproof roof deck covering. Finally, the completed shingles are formed into bundles for shipment.

Figure 7:
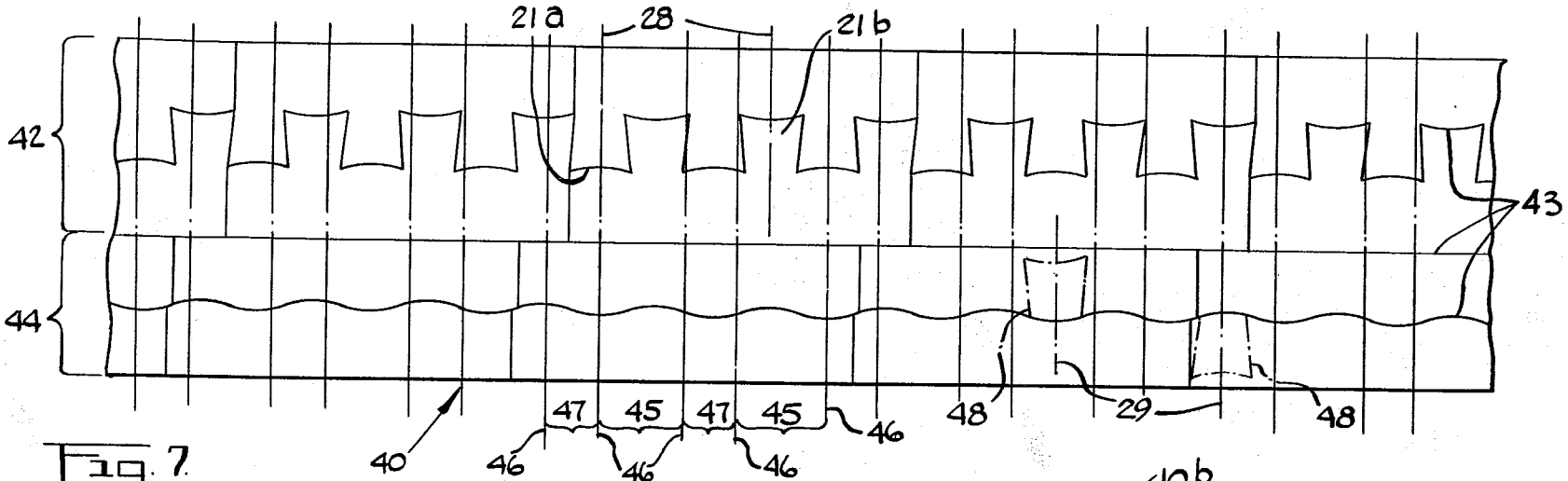
FIG. 7 is a diagramatic showing of a portion of the process illustrated in FIG. 6.

The details of the above disclosed method which in preferred form provide certain unique advantages to Applicant's invention can be better understood with reference to FIG. 7. FIG. 7 shows, in schematic form, felted material 40 which has been provided with a mineral granule coating as set forth above and which has positioned thereon the pattern which corresponds to the cuts which would subsequently be made by the cutter roll as set forth above. Felted material 40 is shown to be divided into overlay area 42 and underlay area 44. It should be understood that such a division of felted material 40 is done for the purposes of schematically showing how the overlay and underlay patterns correspond to the color drop bands and does not necessarily constitute the desired method of cutting these portions from felted material 40. In actuality, Applicants envision cutting a plurality of pairs of underlay members from a continuous band of felted material and on a separate machine (or the same machine on a separate production run) cutting pairs of overlay members from another length of felted material 40. In the alternative, one could choose to form the underlay and overlay members from a band of felted material 40 in a manner similar to that shown in FIG. 7, or, depending on the width of the available felted material, one could choose to define a plurality of parallel overlay pair areas 42 and/or underlay pair areas 44. It should also be pointed out that at no time during the envisioned process is there an appreciable length of felted material 40 which would have the visual appearance as that shown in FIG. 7, since the pattern similar to that shown in FIG. 7 made by the cutter rolls in their operation of cutting out underlay members or overlay members is essentially destroyed when the pairs thus formed are immediately separated from one another by the plow for subsequent operations. The cutter patterns are shown in FIG. 7 to illustrate the relationship of such patterns to the color drop patterns provided in the preceding color drop step of the process. The configuration shown in FIG. 7 is equivalent to that which would result if one reassembled the overlay members or underlay members which had just been cut from an arbitrary length of felted material 40. Lines 46 represent the junctures between adjacent color drops of colored mineral granules.

Preferably, and perhaps inevitably in the practical application of the color drop technique, these junctures 46 comprise transition areas between each adjacent color drop. These transition areas consist essentially of a definable area of a gradual blending between the color granules which comprise each adjacent color drop such that a gradual shading from the color of each color drop results. As stated previously, preferably each color drop (here shown as color drop 45) alternates between composite color drop 47. In Applicants' preferred embodiment each color drop 45 is about 9 inches (22.9 cm) wide, and each composite color drop 47 is about 5 inches (12.7 cm) wide. Because of this spacing the transition areas 46 occur at varying positions relative to the cutter pattern 43. Hence, those transition areas 46 occur at random locations on the finished overlay and underlay members. In like manner, of course, color drops 45 and composite color drops 47 occur at random positions along the cutter patterns. In some areas, for example at tab 21*a*, a transition area occurs approximate to the centerline thereof.

In contrast, 21*b* occurs approximate the center of one color drop 45. Hence, its color hue is substantially one solid color, since no transition area 46 occurs within its area.

Equivalent relationships exist between transition zones 46, color drop and composite color drop areas 45 and 47, and the exposed portions of the underlay member (shown in FIG. 7 by phantom lines 48). Clearly, however, the transition zones 46 and color drops 45 and 47 would occur in any position relative to the tabs and the exposed portions. However, in general, the examples as set forth above define the two broad categories into which virtually all positional relationships will fall. It has been found that when a transition zone 46 falls approximate to centerlines 28 or 29, the gradual shading from one color drop to the next provided by transition zone 46 optically simulates the shading which would result from light falling obliquely on a concave or convex cylindrical shape, as for example a valley or ridge of a roofing tile. This is true whether or not the transition area 46 is positioned between a color drop which is lighter or darker than its just preceding color drop. Put another way, this cylindrical volume or cavity simulating shading is effective whether the shading proceeds from a lighter or darker color from right to left across the simulated cylindrical surface, or proceeds from a darker to a lighter color as perceived from right to left.

In contrast to the above outlined situation as illustrated by tab 21*a*. Tab 21*b* has no effective color transition across its width since it, as stated before, occurs substantially in the middle of color drop 45. In absence of such color transition, clearly color tab 21*b* does not benefit directly from a color transition in order to simulate a convex tile member. However, such a solid color area, when combined with other solid color areas, i.e., tabs 21 and spaces 23 in an overall roof, presents a pleasing variation in tone which in and of itself simulates the natural color variations which occur in a fired clay tile roof for example, which further aids in creating a pleasing visual effect.

When a laminated shingle such as that shown in FIGS. 1, 3 and 4 are created from underlay members and overlay members produced by the method as illustrated in FIGS. 6 and 7, the overall visual effect, when combined with other similarly shaped and mineral granule covered shingles, is quite striking. While the reason for this striking effect can only be speculated upon, an exposition of such speculation will aid in further pointing up the patentable aspects of the instant invention.

As with other prior art laminated shingles which incorporate a similar random color drop mineral granule covered surface, the spaces 23, defined by the exposed portions of each underlay member 14, have mineral granule covered surfaces which contrast sharply with the immediately adjacent tabs 20. This is so since, in general, the mineral granules covering their respective surfaces resulted from different color drops in the substantially random sequence provided by the granule dropping machinery. When placed in juxtaposition with other similarly colored shingles there is, as stated before, an overall impression of randomly colored separate roof covering members rather than groups of such members as defined by each separate shingle. However, in contrast with other prior art shingles, such as those used to simulate a shake roof, the precise vertical alignment of tabs 21 and spaces 23 serve to emphasize vertical component of the overall roof covering rather than a substantially random sequence of shake simulating tabs and spaces arranged in substantially horizontal courses. Also, in contrast with other roofs, visual cues established by the unique shape of each substantially identical tab 20 and space 23 cooperate with one another to apparently evoke a series of alternating convex cylindrical members (ridge tiles) and immediately adjacent concave cylindrical members (valley tiles). These optical cues include the generally negatively curving lower edge of each tab 21 and the generally tapering straight side portions on either side of the lower edge of each tab. These features, combined with the shadow-lines created at the butt edge of each shingle and by the butt edge of each shingle aligned with the lower edge of the head lap portion 16 of each shingle, combine to effectuate a three dimensional illusion. Given this preexisting mental set, the observer, on an almost subliminal level, becomes cognizant of the delicate shading provided random tabs 21 and spaces 23 by the occurrence of the transition zone 46 approximate the centerlines thereof. The effect of these transition zones seems to dominate the relatively flat shading of other tabs 21 or spaces 23 adjacent thereto since the regular repeating curves of the butt edges of each tab and each space in a vertical line indicates, despite the flat tonal rendition of a particular tab or space, that it too is curved in a manner equivalent to the properly shaded tab or space. For example, assume that the center tab of shingle 10*a* in FIG. 5 has a transition zone approximate the centerline thereof. This transition zone defines a shading from left to right of a darker shade to a lighter shade. This, combined with the curving upper edge and lower butt edge thereof together with the generally tapering straight sides, would indicate a light source to the right of the simulated cylindrical member. Also, let the tab of shingle 10*b* which is vertically aligned with the shaded tab of 10*a* (that is, the left-most tab of shingle 10*b*) be covered with mineral granules having only one dominant color (that is, was positionally aligned, in the sense of FIG. 7, with a color drop 45). The shading effect on the center tab of shingle 10*a* would dominate the shading of the left-most tab of shingle 10*b* since such shading is consistent with all other visual cues in the observer's immediate field of vision surrounding the shaded tab. This being the case, the shape indicated by all the visual cues associated with that tab defines the shape of all the adjacent tabs in that vertical row since the illusion is that the tabs in that row consist of a series of nested convex cylindrical members.

One could imagine the above scenario being replayed at spaced locations throughout the shingle covered roof deck D. While the precise mechanisms are speculative as stated before, the overall impression is a roof covered with randomly colored, three dimensional tiles. The simulation is quite effective and achieves this aesthetic function in a most economical manner. The preferred embodiment makes use of existing shingle technology, specifically that technology used to simulate a shake roof with, in a visual sense, a completely opposite result. Such technology permits the utilization of felted material 40 to the maximum extent, eliminating cut-out strips, etc., which would otherwise be waste. The present invention utilizes known mineral granule covering techniques, which techniques have been proven in the past to be of great economic advantage. The present invention does not require coordinating any special shading transitions with the butt edge pattern created by tabs and spaces, since such correlation would either make the shingles made thereby prohibitively expensive, or in a practical sense be impossible to achieve on a mass production basis. Also, the instant invention permits the simulating of a tile covered roof using a relatively standard shape and size of laminated shingle, thus using conventional application techniques.

We claim:

1. A method of forming a laminated roofing shingle comprising:

(a) providing an indefinite length of asphalt-impregnated, felted material;

(b) adhering a coating of mineral granules to at least one surface of said felted material;

(c) cutting said material in a repeating pattern along the longitudinal dimension of said material so as to form an interleaved series of tabs of pairs of overlay members, each said tab, defined by said step of cutting, being of substantially identical shape and the lower edge of each said tab being defined by a smoothly curving negatively contoured edge;

(d) making pairs of underlay members in a similar manner as above but wherein the lower edges of the underlay members are defined by a substantially continuously curving sinuous cut having a uniform periodic shape and amplitude such that each pair of underlay members thus formed are substantially identical; and (e) laminating said underlay members to said overlay members so as to form a series of shingles having substantially the same overall shape, wherein said step of laminating further includes the step of positioning said negatively contoured edge of each said tab directly over a substantially correspondingly curving portion of the lower edge of each said underlay member so as to simulate a series of alternating ridges and valleys of a portion of a tile covered roof.

2. A method as set forth in claim 1 wherein the step of adhering comprises adhering an essentially random series of color drops of said mineral granules each said color drop extending across the width of said felted material;

and wherein adjacent color drops present contrasting colors with adjacent color drops blending at least to some extent with each other so as to form transition zones therebetween.

3. A method as set forth in claim 2 wherein said step of adhering includes the step of alternating said color drops with color drops of a composite of granules having the colors selected from each of said contrasting color drops, said composite granule color drops having a length in the longitudinal direction of said felted material of approximately 5 inches (12.7 cm), said contrasting color drops having a length in the longitudinal dimension of said felted material of approximately 9 inches (22.86 cm).

4. A method of forming a laminated roofing shingle comprising:

(a) providing an indefinite length of asphalt-impregnated, felted material;

(b) adhering a coating of mineral granules to at least one surface of said felted material;

(c) cutting said material in a repeating pattern along the longitudinal dimension of said material so as to form an interleaved series of tabs of pairs of overlay members, each said tab, defined by said step of cutting, being of substantially identical shape and the lower edge of each said tab being defined by a smoothly curving negatively contoured edge;

(d) making pairs of underlay members in a similar manner as above but wherein the lower edges of the underlay members are defined by a substantially continuously curving sinuous cut having a uniform periodic shape and amplitude such that each pair of underlay members thus formed are substantially identical; and (e) laminating said underlay members to said overlay members so as to form a series of shingles having substantially the same overall shape, wherein the step of laminating includes the step of positioning said underlay members and said overlay members relative to one another such that the lower edge of each said tab is longitudinally aligned with a corresponding negatively curved portion of the lower edge of said underlay member.

5. A method of optically simulating a tile covered roof comprising:

(a) forming a series of substantially identical shingle overlay members, each said overlay member comprising a series of substantially uniformly shaped tabs, each said tab having a negatively curving contour at the lower edge thereof and each said tab having a width defined by generally straight edges, said straight edges tapering inwardly to a width narrower than the width at said lower edge;

(b) forming a series of substantially identical underlay members, each underlay member having a lower edge with a substantially continuously curving uniformly periodic undulating contour;

(c) bonding one of said series of overlay members to one of said series of said underlay members so as to form a shingle of generally rectangular form having a headlap portion and a butt portion, said butt portion comprising a series of uniformly spaced double-thick tab portions with a space between each tab portion defining an exposed portion of said underlay member, the step of bonding further includes the step of positioning said one of said series of overlay members and said one of said series of underlay members relative to one another such that the lower edge of each said tab is longitudinally aligned with a corresponding negatively curved portion of the lower edge of said underlay member;

(d) repeating the step of bonding to form a plurality of laminated shingles; and (e) covering a roof deck with the thus formed laminated shingles by, (i) laying said shingles side-by-side in a horizontal course, (ii) overlapping said course by a next higher course of shingles such that said headlap portion of each shingle therein is substantially covered by the butt portions of the shingles in said next higher course, (iii) vertically aligning the tabs of each shingle with the tabs of the shingles in each succeeding course such that said tabs form vertical lines proceeding up the roof deck and the spaces form lines parallel to the lines of said tabs such that the vertical patterns and curving butt edges of said tabs and spaces optically cooperate to simulate a tile covered roof.

6. A method as set forth in claim 5 wherein said underlay members and said overlay members are covered with mineral granules having substantially randomly varying color drop patterns making up said granule covered surface.

7. A method as set forth in claim 5 wherein said shingles in said each succeeding course are horizontally offset from the shingles in adjacent courses.

8. A method as set forth in claim 4 wherein said lower edge of each said tab and said corresponding negatively curved portion of said lower edge of said underlay member are slightly offset laterally from one another.

* * * * *